US006607374B2

(12) United States Patent
Hastie et al.

(10) Patent No.: US 6,607,374 B2
(45) Date of Patent: Aug. 19, 2003

(54) APPARATUS FOR CONSTANT DIAGONAL HETEROFIL SPINNERET HOLE LAYOUT

(75) Inventors: Allan James Hastie, Charlotte, NC (US); David Wayne Goode, Cornelius, NC (US); Charles Eugene Justis, Concord, NC (US)

(73) Assignee: Arteva North America S.A.R.L., Zurich (CH)

( * ) Notice: Subject to any disclaimer, the term of this patent is extended or adjusted under 35 U.S.C. 154(b) by 195 days.

(21) Appl. No.: 09/825,501

(22) Filed: Apr. 3, 2001

(65) Prior Publication Data

US 2002/0140126 A1 Oct. 3, 2002

(51) Int. Cl.[7] ..... B29C 47/00; D01D 5/34

(52) U.S. Cl. ..... 425/131.5; 425/133.1; 425/464; 425/382.2; 425/DIG. 217

(58) Field of Search ..... 425/131.5, 133.1, 425/464, 463, 72.2, DIG. 217, 382.2; 264/DIG. 26, 171.1, 172.11, 172.14, 172.15

(56) References Cited

U.S. PATENT DOCUMENTS 992,369 A * 5/1911 Martoccio ..... 425/464
3,457,342 A * 7/1969 Parr et al. ..... 264/169
4,088,433 A * 5/1978 Simpson ..... 425/464
5,624,754 A * 4/1997 Choe et al. ..... 428/373
6,284,174 B1 * 9/2002 Ueda et al. ..... 264/104

* cited by examiner

*Primary Examiner*—Robert Davis
*Assistant Examiner*—Joseph S. Del Sole

(57) ABSTRACT

An apparatus for spinning bicomponent sheath/core filaments such that the filaments are uniformly quenched. The apparatus includes a distributor plate, and spinneret and a shim position between the distributor plate and the spinneret. The spinneret includes a plurality of holes positioned so that the density of holes is the lowest near the center of the spinneret and increases as radially proceed outward. More specifically, the holes are substantially configured in the shape of a parallelogram in which the sides of the parallelogram are all of equal length. Additionally, the shape of the parallelogram is more flat the further the parallelogram pattern is located from the center of the spinneret. In this manner of positioning the holes, filaments therefrom do not significantly impede quench air from uniformly reaching filaments in the outer rows.

6 Claims, 4 Drawing Sheets

APPARATUS FOR CONSTANT DIAGONAL HETEROFIL SPINNERET HOLE LAYOUT

BACKGROUND OF THE INVENTION

1) Field of the Invention

The present invention relates to a method and apparatus for spinning bicomponent filaments. More particularly, the invention relates to a spinneret used for bicomponent spinning. The spinneret has a plurality of holes wherein the density of holes increase radially outward from the center of the spinneret.

2) Description of Prior Art

Bicomponent filaments of the sheath/core configuration are well-known and a variety of spinning packs and spinnerets have been employed in the production of textile filaments. A conventional spinning assembly involves feeding molten sheath forming material to the spinneret holes, in a direction perpendicular to the holes, and injecting molten core forming material into the sheath-forming material as it flows into the spinneret holes.

There are several prior art hole layouts for bicomponent spinnerets. One is providing the same number of holes per row. This configuration is typically used for low hole density/high denier per filament (dpf). Another is a constant hole density wherein there are a different number of holes per row and the hole density is constant by having the hole to hole distance in the same row, and row to row distance, constant. This configuration is typically used for high hole density/low dpf. Both of these configurations have the disadvantage that the hole density is higher towards the center of the spinneret than the outer portion of the spinneret, or remains constant throughout the spinneret. Consequently, quench air radiating outward from the center of the spinneret has difficulty reaching filaments in the outer rows. Filaments in the interior rows are quenched first and, therefore, solidify and crystallize before filaments in the outer rows. This causes a distribution in filament uniformity with spun orientation and filament diameter (dpf) according to which row the filament is in.

A distribution of spun yarn orientation is undesirable since this causes broken filaments in the subsequent drawing operation. Thus, when each filament has substantially the same spun orientation, the filaments can be drawn at a high draw ratio without broken filaments. Additionally, by uniformly quenching filaments, conversion is higher, that is, the equipment can be run faster with less stoppage and waste.

Accordingly, there is a need for an improved spinneret wherein the density of holes increase radially outwards from the center of the spinneret and are positioned such that filaments are uniformly quenched and have a higher uniformity in spun orientation than prior art devices.

SUMMARY OF THE INVENTION

The present invention is directed towards a spinneret assembly and method for spinning bicomponent filaments which are substantially uniformly quenched and have a generally uniform spun orientation so that filaments can be drawn with less waste. The spinneret accomplishes this result by arranging spinneret holes in a generally parallelogram pattern having a constant diagonal distance between holes such that the hole density increases in the direction away from the center of the spinneret thereby ensuring that radial quench air uniformly reaches all the filaments.

According to the present invention, the spinneret assembly includes a distributor and a spinneret. The distributor is provided with separate flow passages to convey core polymer and sheath polymer to the spinneret. The spinneret is provided with a plurality of bosses, each having a hole, which coaxially align with the distributor core passages for receiving the core polymer. The holes are arranged in increasing density from a center position of the spinneret to an outer edge of the spinneret.

According to another aspect of the present invention, the holes are arranged in curvilinear rows and the distance between a hole in one row to a nearest hole in an adjacent row is constant for all such pairs of holes.

According to a further aspect of the present invention, the holes in alternative rows are radially aligned.

According to still another aspect of the present invention, the distance between succeeding rows decreases radially from a center position to an outer edge of the spinneret.

According to another aspect of the present invention, a method is provided for making a bicomponent filament. The method includes providing a distributor having separate flow passages for core polymer and for sheath polymer. A spinneret is provided with bosses and is secured beneath the distributor. Holes are placed in the bosses which extend through the bosses and the spinneret. The holes are coaxially aligned with the core polymer passages. Moreover, the holes are arranged in curvilinear rows and in increasing density in a radial direction from the center of the spinneret to an outer edge of the spinneret. Molten core polymer and molten sheath polymer are supplied to the distributor, forced through respective passages, to the spinneret. The molten core polymer flows through the spinneret holes. The molten sheath polymer flows over the bosses and through the holes forming a sheath about the core polymer. The sheath-core polymer is then substantially uniformly quenched.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
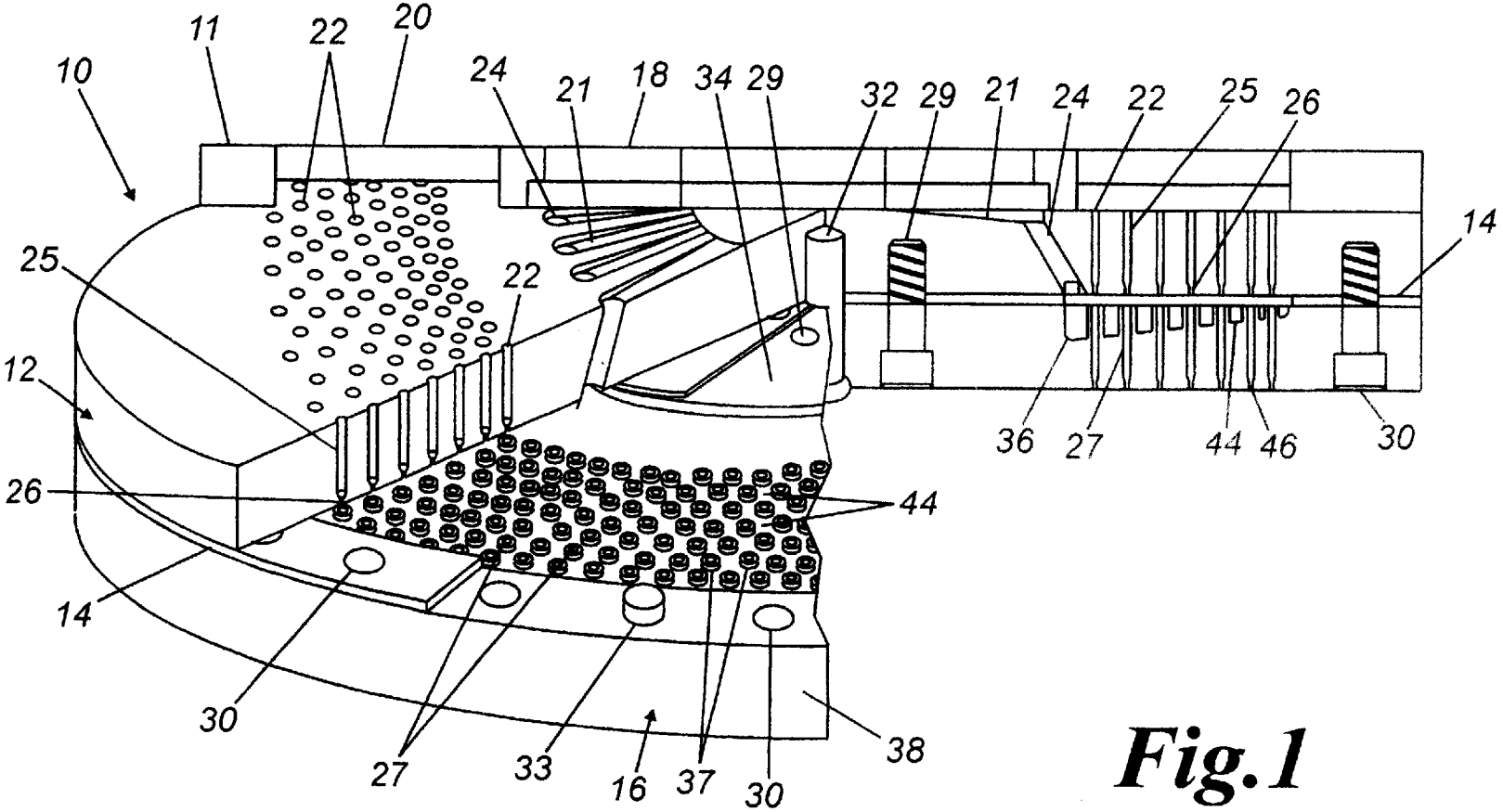
FIG. 1 is a fragmented perspective view of a spin pack assembly according to the preferred embodiment of the invention.
Figure 2:
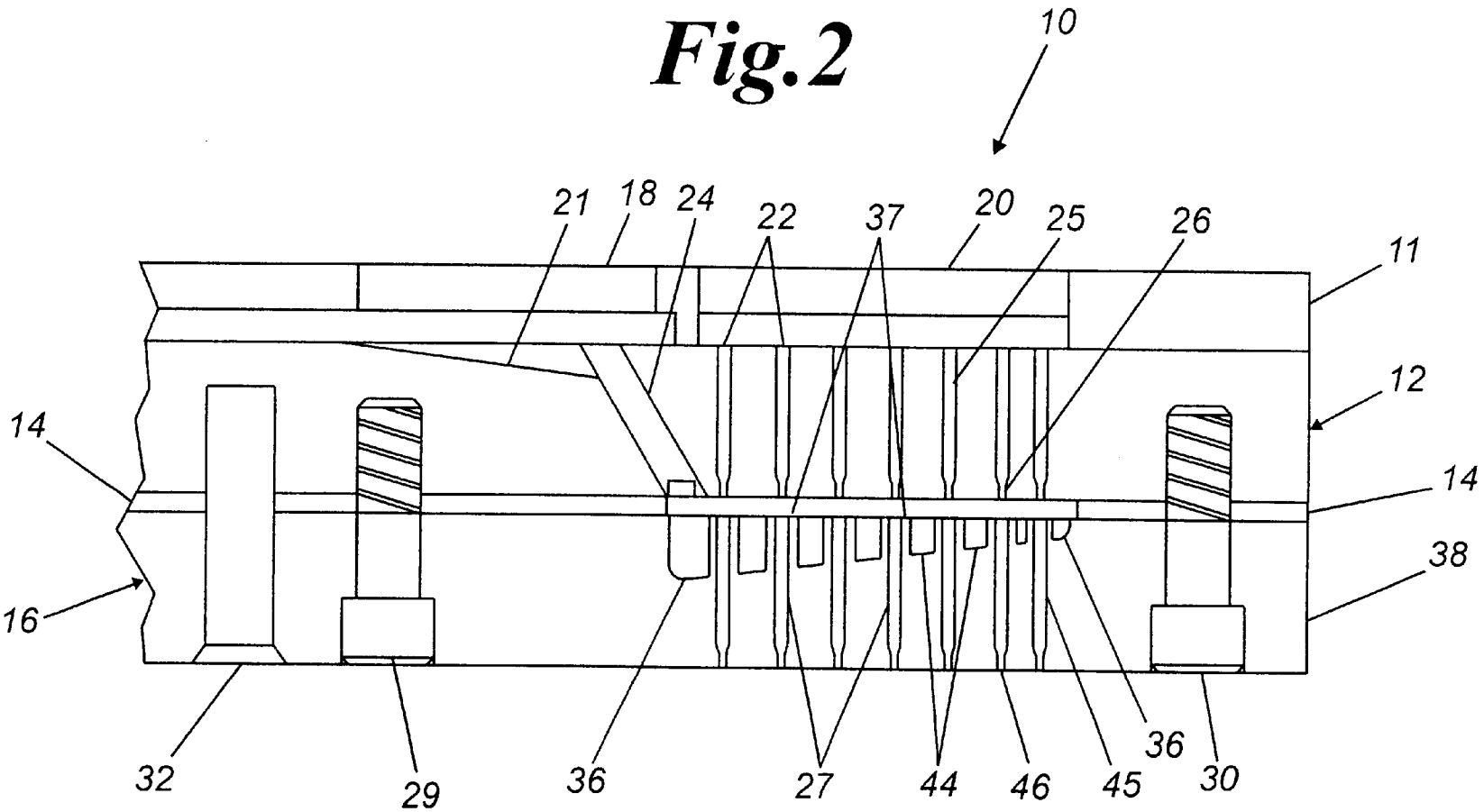
FIG. 2 is a fragmented elevational view, in cross section, of the spin pack assembly of FIG. 1.

FIGS. 1 and 2 illustrate a spin pack assembly 10 according to the present invention. The spin pack assembly 10 includes a supply manifold 11, a distributor 12, a shim 14 and a spinneret 16. The manifold 11 delivers molten sheath polymer and molten core polymer through respective feed conduits 18, 20 to the distributor 12. The sheath and core polymers can be any melt spinnable polymer such as, for example, polyolefin, polyester, or nylon. The sheath and core polymers are passed to the respective feed conduits 18, 20 by conventional pump and filter means not herein illustrated. The distributor 12 is positioned beneath the manifold 11 to receive the sheath and core polymers.

The distributor 12 includes radially outward directed feed channels 21, outer passages 22 to form the core polymer into filaments and inner passages 24 to convey the flow of sheath polymer to the spinneret 16. The radial feed channels 21 direct sheath polymer from the feed conduit 18 to the inner passages 24. The inner passages 24 can be vertical or can be slanted as necessary to avoid obstructions such as bolts. The outer passages 22 have an upper counterbore 25 and a lower tapered bottom 26 to provide a core filament of desired diameter. The outer passages 22 are arranged to coaxially align with spinneret holes 27.

The shim 14 has an uniform thickness and is positioned between, and slightly separates, the distributor 12 and the spinneret 16. Preferably the shim 14 is constructed with a separate inner and outer section. The inner and outer shim 14 sections are maintained in fixed relationship to the distributor 12 and spinneret 16 by a respective ring of inner and outer bolts 29, 30 engaging threaded recesses in the distributor 12. The bolts 29, 30 also overcome bowing and separation of the distributor 12 and spinneret 16. The distributor 12 and spinneret 16 are relatively positioned by a central dowel pin 32 in the center of the spin pack 10 and outer dowel pins 33 interspersed along the outer ring of bolts 30. Alternatively, the shim can be a unitary. The unitary shim substantially covers the spinneret and has holes provided in alignment with distributor passages 22, 24 and spinneret orifices 27. The shim 14 can be manufactured from a variety of materials such as stainless steel or brass. The thickness of the shim 14 is selected according to a variety of operating parameters such as the sheath polymer viscosity and desired pressure drop across the top of the spinneret 16.

The spinneret 16 includes a central hub 34, a recessed section 36, bosses 37 and an outer rim 38. The recessed section 36 receives sheath polymer from the distribution inner passages 24. As shown in FIG. 2, the recessed section 36 is preferably sloped upwards from the central hub 34 to the outer rim 38 to maintain the sheath polymer under constant pressure. The recessed section 36 is provided with vertically extending bosses 37 thereby forming pathways 44 between the bosses 37. The bosses 37 extend upward terminating in a plane common to the top surface of the outer rim 38 and the central hub 34.

The rate of outward flow of sheath polymer through the pathways 44 and over the bosses 37 to the holes 27 is a result of the pressure drop determined by the shim gap between the distributor 12 and the spinneret 16. The varying depth of the sloped recessed section pathways 44 is selected to provide a low pressure drop radially across the top of the spinneret 16, and the shim 14 thickness is selected to provide a higher pressure drop across the bosses 37. The outer rim 38 forms an outer boundary restricting the sheath polymer and includes the outer rings of bolts 30 joining the distributor 12, shim 14 and spinneret 16.

Figure 3:
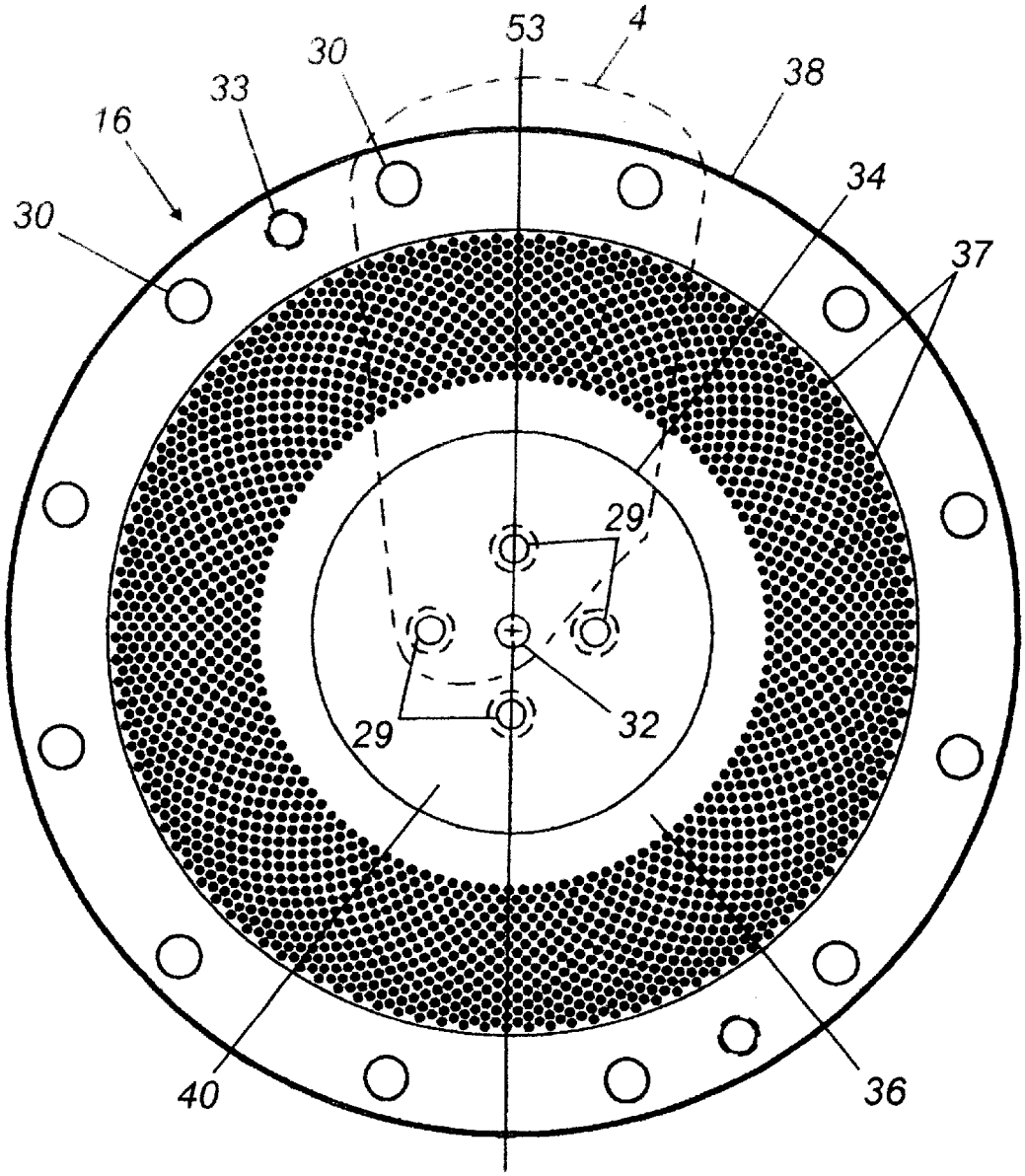
FIG. 3 is a plan view of a spinneret having holes arranged in a substantially parallelogram pattern having a specific diagonal length.
Figure 4:
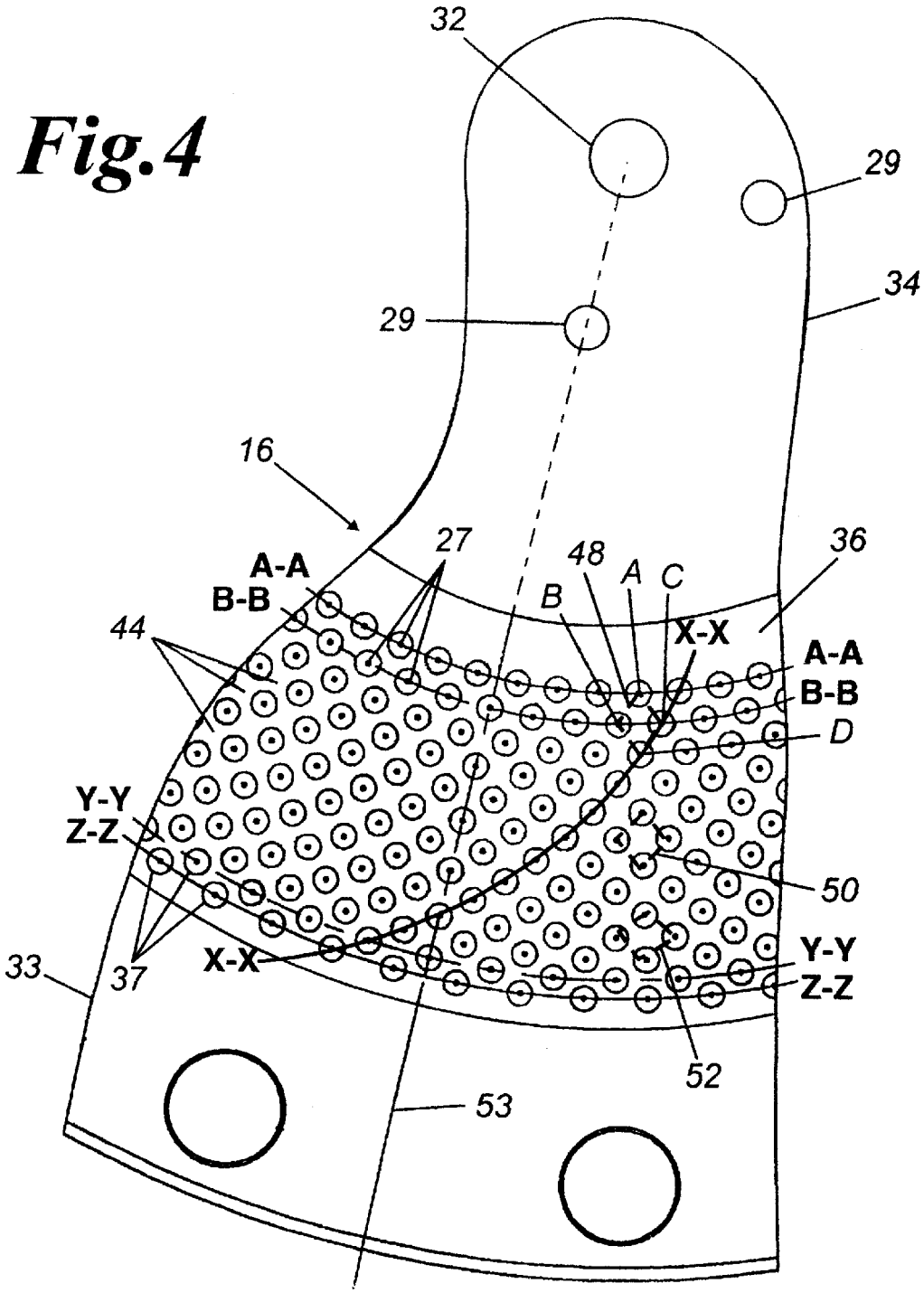
FIG. 4 is an enlarged sectional view of FIG. 3, of detail section 4.

FIG. 3 shows the layout of the bosses 37 in the spinneret 16. As shown in FIG. 4, the bosses 37 have holes 27 which are arranged substantially in a parallelogram pattern 48 (shown by dashed lines). That is, the holes form indices substantially of a parallelogram wherein opposed sides are very slightly nonparallel. The parallelogram pattern 48 formed by four adjacent holes in three consecutive rows: one hole (labeled A) in the inner row, two holes (labeled B and C) in the middle row and one hole (labeled D) in the outer row. Lines AB and CD are slightly non-parallel as are lines AC and BC because the holes 27 are positioned along a spiral curve, as indicated, for example, by spiral lines X—X. The substantially parallelogram pattern exist for all groupings of four holes as just described. Moreover, the parallelogram pattern flattens and widens the further the holes are located away from the center of the spinneret 16. Three sets of dashed lines 48, 50, 52 are designated to illustrate the parallelogram pattern changing from a narrow to a wide shape. The parallelogram pattern is also defined by a constant diagonal length. The constant diagonal length is the distance between adjacent holes on the same parallelogram, such as for example the distance AB. This distance is the same for adjacent holes in the same parallelogram as it is for all parallelograms throughout the spinneret 16.

The location of the holes 27 is further defined in that they are in circular rows. Each sequential row, from the central hub 34 of the spinneret 16 outward to the outer rim 38, is positioned closer to the subsequent row than to the preceding row. A comparison of the distance between the innermost two rows A—A, B—B and the distance between the outermost two rows Y—Y, Z—Z illustrates that the distance between rows decrease radially outwards from the center of the spinneret 16. Moreover, holes from alternating rows are radially aligned from the center of the spinneret 16 as shown by radial line 53 of FIG. 4.

The positioning of the holes 27 results in a spinneret 16 having a hole density, the number of holes per $cm^2$, which increases from the central hub 34 to the outer rim 38 of the spinneret 16. Consequently, quench air is minimally impeded by the curtain of filaments in the inner rows of the spinneret 16 so that all filament rows are uniformly quenched and spun orientation is substantially uniform. The benefit of a spinneret having a constant diagonal hole 27 arrangement is equally applicable to mono-polymer filament production.

The bosses 37 preferably are cylindrical and equidistantly spaced from each other. Specifically, the bosses 37 are equidistant along the constant diagonal such that the pathway width between adjacent bosses 37 is the same. Current manufacturing restrictions require a separation of at least one millimeter between adjacent bosses 37. The present invention incorporates advances in manufacturing techniques such that the bosses 37 can be spaced closer than today's current limitation.

Alternative boss configurations are within the scope of invention so long as the spinneret holes are in the substantially parallelogram pattern. For example, a spiral elongate boss can be used as shown in U.S. patent application Ser. No.09/827,792 to Goodall, McConnell and Hastie filed on Apr. 6, 2001.

In use, the distributor 12 receives core and sheath polymer from the manifold 11 through respective inner and outer feed conduits 20, 18. The distributor 12 forms the core polymer into filaments and directs the flow of sheath polymer to the spinneret 16. The core polymer is pumped to, then through, the outer passages 22 and is received by the spinneret holes 27. The sheath polymer is pumped to feed channels 21, then outwardly within the feed channels 21 to the inner passages 24 and therethrough to the recessed section 36 of the spinneret 16. The pressure drop between the top surface of the boss 37 and the bottom surface of the distributor 12, and the pressure drop between the channels and the bottom of the distributor creates an overall pressure drop forcing the sheath polymer through the channels 44 and over the bosses 37 to the holes 27. The recessed section 36 slopes upward toward the outer rim 38 to compensate for the reduced volume of sheath polymer, and maintain uniform pressure for even flow.

Since the distributor outer passages 22 are in coaxial alignment with the corresponding holes 27, the core polymer flows from the core polymer passages, through the spinneret holes 27, and exits the spinneret 16 as a core of a bicomponent fiber. The sheath polymer flows through the sheath polymer passages 24, into the recessed section 36 of the spinneret 16, over the bosses 37 to form a sheath about the core polymer and exits the holes 27 where it is quenched by air beneath the spinneret 16 (not shown) radiating from the center of the spinneret 16 and forms a bicomponent fiber. Since the filament density increases away from the center of the spinneret 16 the inner filaments do not significantly impede the flow of quench air to the outer filaments, the filaments are more uniformly quenched and have greater uniformity in spun orientation.

The spinneret assembly can also be employed to produce a sheath core bicomponent fibers where the core has a non-circular cross section. Examples of non-circular cross-sections are shown in U.S. Pat. No. 5,256,050, and are herein incorporated by reference.

Although particular embodiments of the invention have been described in detail, it will be understood that the invention is not limited correspondingly in scope, but includes all changes and modifications coming within the spirit and terms of the claims appended hereto.

We claim:

1. A spin pack assembly for the production of sheath-core bicomponent filaments comprising:

a distributor having a plurality of core polymer flow passages and a sheath polymer flow passage;

a spinneret secured relative to said distributor;

a plurality of bosses integral with said spinneret; and a hole in each of said bosses which extends through said bosses and said spinneret, each of said holes coaxially aligned with a respective outlet of said core polymer flow passage and each said holes taken together comprises holes which are arranged in increasing density as they radially proceed outward from a center position of said spinneret to an outer edge of said spinneret, wherein said holes are in rows, and holes of alternating rows are radially aligned, and the distance between said alternating rows decreases, proceeding radially to said outer edge of said spinneret.

2. The spin pack assembly of claim 1 wherein said holes are positioned in curvilinear rows.

3. The spin pack assembly of claim 2 wherein the distance between a hole in one row to a nearest hole in an adjacent row is the same throughout the spinneret.

4. The spin pack assembly of claim 2 wherein said holes have a constant diagonal distance between adjacent holes in adjacent rows.

5. The spin pack assembly of claim 2 wherein one hole in one row, two nearest holes in an adjacent middle row and one hole in an outer row adjacent to said middle row form a substantially parallelogram pattern.

6. The spin pack assembly of claim 2 wherein the distance between succeeding rows decrease proceeding radially from a center position to outer edge of said spinneret.

* * * * *